US010847096B2

(12) United States Patent
Yang et al.

(10) Patent No.: US 10,847,096 B2
(45) Date of Patent: Nov. 24, 2020

(54) DRIVING MODULE OF ORGANIC LIGHT EMITTING DIODE DISPLAY CAPABLE OF PROTECTING CIRCUIT ELEMENTS BY SHIFTING WORKING VOLTAGE RANGE

(71) Applicant: FORCELEAD TECHNOLOGY CORP., Hsinchu County (TW)

(72) Inventors: Wen-Lin Yang, Hsinchu County (TW); Chih-Lung Kuo, Hsinchu County (TW)

(73) Assignee: FORCELEAD TECHNOLOGY CORP., Hsinchu County (TW)

( * ) Notice: Subject to any disclaimer, the term of this patent is extended or adjusted under 35 U.S.C. 154(b) by 0 days.

(21) Appl. No.: 15/156,347

(22) Filed: May 17, 2016

(65) Prior Publication Data

US 2017/0098414 A1 Apr. 6, 2017

Related U.S. Application Data

(60) Provisional application No. 62/236,992, filed on Oct. 5, 2015.

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0828* (2013.01);
(Continued)

(58) Field of Classification Search
CPC ..... G09G 3/3611; G09G 3/3614; G09G 3/20; G09G 3/006; G09G 3/3258; G09G 3/3233;
(Continued)

(56) References Cited

U.S. PATENT DOCUMENTS 4,769,753 A * 9/1988 Knudson ..... H02M 3/07 307/110
7,375,575 B1 * 5/2008 Bazes ..... H03F 3/45475 326/68
(Continued)

FOREIGN PATENT DOCUMENTS

CN 101996547 A 3/2011
CN 102024413 A 4/2011
(Continued)

*Primary Examiner* — Julie Anne Watko
(74) *Attorney, Agent, or Firm* — Winston Hsu

(57) ABSTRACT

A driving module for an organic light-emitting diode display device includes a converting unit, for adjusting a voltage range of a plurality of data signals from a first voltage range to a second voltage range; and a driving unit, for generating a plurality of driving signals within the second voltage range to the organic light-emitting diode display device according to the plurality of data signals; wherein the maximum voltage of the second voltage range is greater than or equal to the maximum driving voltage of display components coupled to the driving signals in the organic light-emitting diode display device, and the minimum voltage of the second voltage range is smaller than or equal to the minimum driving voltage of display components coupled to the driving signals in the organic light-emitting diode display device.

12 Claims, 5 Drawing Sheets

(52) U.S. Cl.
CPC ..... *G09G 2300/0838* (2013.01); *G09G 2310/0289* (2013.01); *G09G 2330/028* (2013.01)

(58) Field of Classification Search
CPC .... G09G 3/3275; G09G 3/325; G09G 3/3466; G09G 3/3648; G09G 3/3659; G09G 3/3674; G09G 3/3685; G09G 3/3688; G09G 2300/0814; G09G 2300/0819; G09G 2300/0861; G09G 2300/0866; G09G 2300/0408; G09G 2300/0842; G09G 2300/0809; G09G 2300/0838; G09G 2310/0232; G09G 2310/0289; G09G 2310/0297; G09G 2310/08; G09G 2310/027; G09G 2320/0247; G09G 2320/029; G09G 2320/043; H03K 19/018521; H03K 19/0016; H03K 17/102; H03K 3/356147; H03K 3/356113; H03K 3/356165; H03K 3/356017
See application file for complete search history.

(56) References Cited

U.S. PATENT DOCUMENTS

2002/0033783 A1* 3/2002 Koyama ..... G09G 3/3233 345/82
2003/0137521 A1* 7/2003 Zehner ..... G02F 1/167 345/589
2003/0151570 A1* 8/2003 LeChevalier ..... G09G 3/3216 345/84
2004/0174282 A1* 9/2004 Sun ..... G09G 3/3283 341/136
2006/0038756 A1* 2/2006 Bae ..... G09G 3/3216 345/76
2006/0202913 A1* 9/2006 Hayafuji ..... G09G 3/3233 345/44
2008/0068310 A1 3/2008 Choi
2009/0027100 A1* 1/2009 Choi ..... G09G 3/3266 327/333
2012/0206506 A1* 8/2012 Kim ..... G09G 3/20 345/690
2013/0127806 A1 5/2013 Wu
2013/0170607 A1* 7/2013 Matsui ..... G11C 19/184 377/77
2016/0321981 A1* 11/2016 Harrington ..... G09G 3/344
2017/0025061 A1* 1/2017 Takizawa ..... G09G 3/3233

FOREIGN PATENT DOCUMENTS

JP WO 2015151927 A1 * 10/2015 ..... G09G 3/3233
KR 10-1226984 2/2013
KR 10-1510884 B1 4/2015
TW 480822 3/2002
TW I239496 9/2005
TW 200608343 3/2006
TW 201128603 A1 8/2011
TW I395191 B1 5/2013
TW 201322221 A1 6/2013

* cited by examiner

DRIVING MODULE OF ORGANIC LIGHT EMITTING DIODE DISPLAY CAPABLE OF PROTECTING CIRCUIT ELEMENTS BY SHIFTING WORKING VOLTAGE RANGE

CROSS REFERENCE TO RELATED APPLICATIONS

This application claims the benefit of U.S. Provisional Application No. 62/236,992 filed on Oct. 5, 2015, the contents of which are incorporated herein in their entirety.

BACKGROUND OF THE INVENTION

1. Field of the Invention

The present invention relates to a driving module, and more particularly, to a driving module for Organic Light Emitting Diode Display.

2. Description of the Prior Art

Electroluminescent display devices can be implemented without color filters and equip with advantages of self-luminous (i.e. backlight module can be omitted) and low power consumption. Thus, the electroluminescent display device is expected to be a mainstream of next generation display technology. Among various kinds of the electroluminescent display devices, Organic light emitting diode (OLED) display is one of relatively matured technologies.

Because voltage specifications of the OLED display are different from those of a conventional liquid crystal display (LCD), driving modules (e.g. driver integrated circuits (ICs)) used to drive the OLED display have to be realized in a special and new process to fit the specifications of the OLED display. However, the driving modules realized in the new process may need significant amount of time to improve yields. In addition, production capacity of the new process may be not able to meet the needs of the market. Thus, how to use mature processes to realize the driving modules of OLED display becomes a topic to be discussed.

SUMMARY OF THE INVENTION

In order to solve the above problem, the present invention provides a driving module for an organic light emitting diode display.

In an aspect, the present invention discloses a driving module for an organic light-emitting diode display device. The driving module comprises a converting unit, for adjusting a voltage range of a plurality of data signals from a first voltage range to a second voltage range; and a driving unit, for generating a plurality of driving signals within the second voltage range to the organic light-emitting diode display device according to the plurality of data signals; wherein the maximum voltage of the second voltage range is greater than or equal to the maximum driving voltage of display components coupled to the driving signals in the organic light-emitting diode display device, and the minimum voltage of the second voltage range is smaller than or equal to the minimum driving voltage of display components coupled to the driving signals in the organic light-emitting diode display device.

In another aspect, the present invention discloses a driving module for an organic light-emitting diode display device. The driving module comprises a converting unit, for adjusting a voltage range of a plurality of data signals from a first voltage range to a second voltage range; and a driving unit, for generating a plurality of driving signals within the second voltage range to the organic light-emitting diode display device according to the plurality of data signals; wherein the maximum voltage of the second voltage range is greater than or equal to the maximum driving voltage of display components coupled to the driving signals in the organic light-emitting diode display device, and the minimum voltage of the second voltage range is smaller than or equal to the minimum driving voltage of display components coupled to the driving signals in the organic light-emitting diode display device; wherein the driving module is realized in a mature process, the maximum voltage of a working voltage range of the mature process is smaller than the maximum driving voltage, and the minimum voltage of the working voltage range of the mature process is smaller than the minimum driving voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
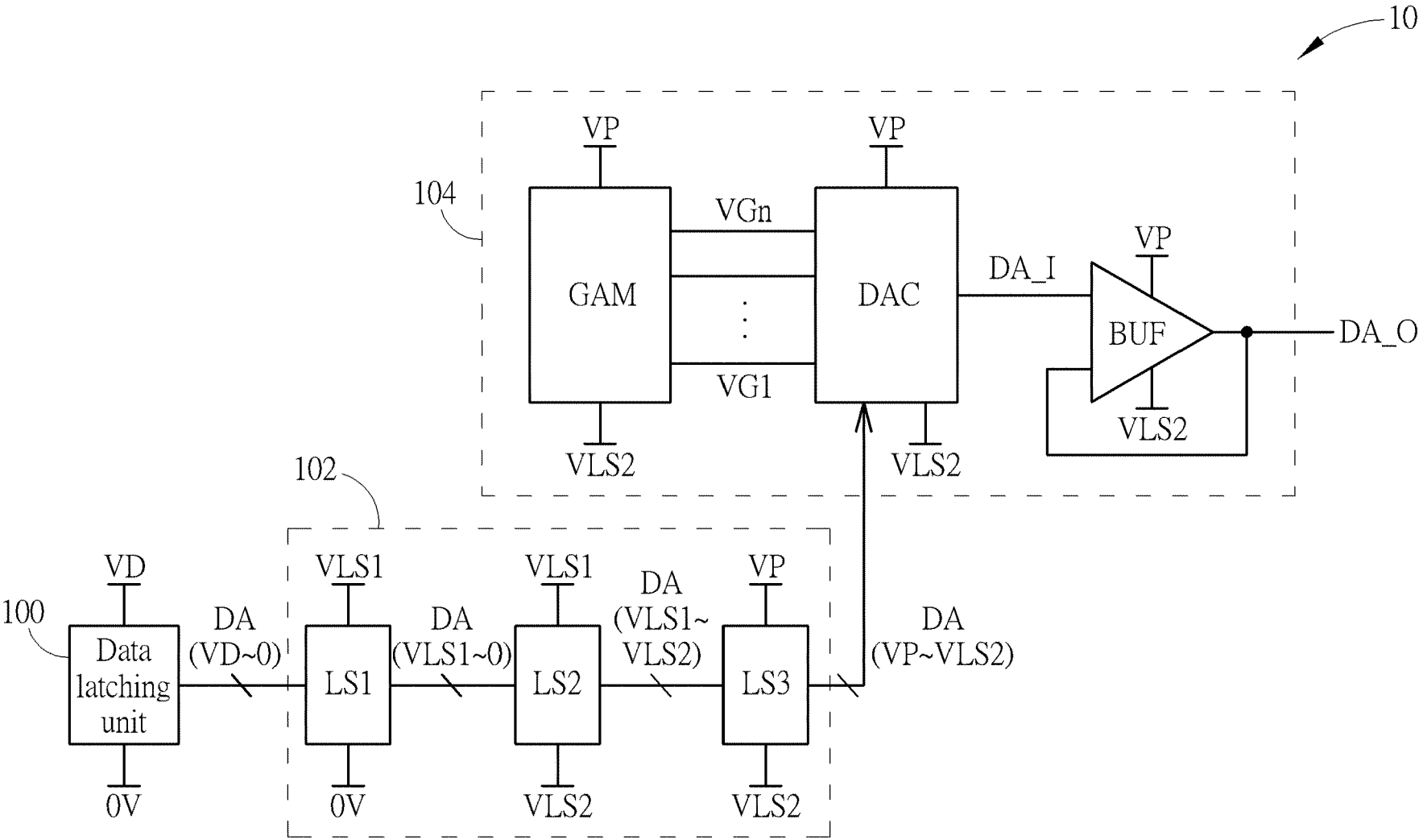
FIG. 1 is a schematic diagram of a driving module according to an example of the present invention.

Please refer to FIG. 1, which is a schematic diagram of a driving module 10 according to an example of the present invention. The driving module 10 may be a driver integrated circuit (IC) used to drive an organic light-emitting diode (OLED) display device (e.g. an OLED display, not shown in FIG. 1). As shown in FIG. 1, the driving module 10 comprises a data latching unit 100, a converting unit 102, and a driving unit 104. The data latching unit 100 is utilized to store display data of display components in the OLED display device and to generate a plurality of data signals DA to the converting unit 102 according to the display data. The converting unit 102 is utilized to adjust a voltage range of the data signals DA and to transmit the adjusted data signals DA to the driving unit 104. The driving unit 104 is utilized to generate a plurality of driving signals DA_O according to the data signals DA, to drive the display components of the OLED display device.

Note that, the driving module 10 is realized in a mature process, such as the process of liquid crystal display (LCD). In the mature process, the maximum voltage of an operating voltage range VRW1 of the middle voltage circuit elements (e.g. the circuit elements in the converting unit 102 and the driving unit 104) is smaller than that of an operating voltage range VRW2 of the display elements (e.g. pixels) in the OLED display device and the minimum voltage of the operating voltage range VRW1 is also smaller than that of the operating voltage range VRW2 of the display elements in the OLED display device. In an example, the maximum voltage of the operating voltage range VRW1 is about 6 volts, the maximum voltage of the operating voltage range VRW2 is about 8 volts, and voltages across the voltage ranges VRW1 and VRW2 are about 6 volts. For example, the voltage range VRW1 is from 0 to 6 volts and the voltage range VRW2 is from 2 to 8 volts. If the maximum operating voltage of the driving unit 104 (e.g. the voltage VP) increases to the maximum voltage of the voltage range VRW2, voltages across the circuit elements of the driving unit 104 may become so great that the circuit elements of the driving unit 104 are damaged. In order to make the driving signals DA_O generated by the driving unit 104 able to drive the display components of the OLED display device while avoiding the circuit elements in the driving unit 104 being damaged, the converting unit 102 adjusts the voltage range of the data signals DA from a voltage range VD-0 to a voltage range VP-VLS2, wherein the voltage VP is greater than or equal to the maximum voltage VG_H of the operating voltage range VRW2, the voltage VLS2 is smaller than or equalized to the minimum voltage VG_L of the operating voltage range VRW2 of the display components in the OLED display device, and a difference between the voltages VP and VLS2 is smaller than the voltage difference across the operating voltage range VRW1 of circuit elements in the matured process. In addition, the working voltage range of the driving unit 104 also changes to be from the voltage VP to VLS2. Under such a condition, the driving unit 104 is able to generate appropriate driving signals DA_O of the display components of the OLED display device and the circuit elements of the driving unit 104 would not be damaged. Via upwardly shifting the working voltage range of the driving unit 104 used to generate the driving signals and the voltage range of the data signals DA, the matured process can be utilized to realize the driving module 10 of the OLED display device.

In details, the data latching unit 100 may be a latch and is utilized to store display data of the display components of the OLED display device and to accordingly generate the data signals DA. The working voltage range of the data latching unit 100 is from voltage VD to ground voltage (i.e. 0 volts), wherein the voltage VD is a working voltage of digital circuits of the driving module 10. Thus, the data signals DA generated by the data latching unit 100 is also between the voltage VD and the ground voltage. The converting unit 102 comprises shifters LS1-LS3. In an example, the shifters LS1-LS3 are level shifters. The shifter LS1 is utilized to shift the maximum voltage of the data signals DA from the voltage VD to a voltage VLS1, wherein the voltage VLS1 is between the voltages VD and VP. The shifter LS2 is utilized to shift the minimum voltage of the data signals DA from the ground voltage to the voltage VLS2, to generate the data signals DA that range from the voltage VLS1 to VLS2. Note that, the voltage VLS2 is smaller than the voltage VLS1 and is greater than the ground voltage. The shifter LS3 is utilized to shift the maximum voltage of the data signals DA from the voltage VLS1 to VP, to generate the data signals DA that range from the voltage VP to VLS2. Because the voltage VLS1 is between the voltages VD and VP, the voltage VLS2 is between the voltage VLS1 and the ground voltage, and the difference between the voltage VP and VLS2 is smaller than or equal to the voltage across the working voltage range VRW1 of the circuit elements in the matured process, voltages across working voltage ranges of the shifters LS1-LS3 are all smaller than or equal to that across the working voltage range VRW1 of the circuit elements in the matured process. Under such a condition, the circuit elements of the shifters LS1-LS3 are not damaged by the voltages across the circuit elements.

In this example, the driving unit 104 comprises a gamma voltage generator GAM, a digital-to-analog convertor DAC and a buffer BUF. The gamma voltage generator GAM is utilized to use the voltages VP and VLS2 to generate gamma voltages VG1-VGn. Because the voltage VP is greater than or equal to the maximum voltage VG_H of the working voltage range VRW2 of the display components in the OLED display device and the voltage VLS2 is smaller than or equal to the minimum voltage VG_L of the working voltage range VRW2 of the display components in the OLED display device, the maximum voltage VGn among the gamma voltages VG1-VGn may be the maximum voltage VG_H of the working voltage range VRW2 and the minimum voltage VG1 among the gamma voltages VG1-VGn may be the minimum voltage VG_L of the working voltage range VRW2. According to different applications and design concepts, the voltages VP, VG_H, VLS2, and VGL may be appropriately altered. In an example, the voltage VP is between 7 and 9 volts, the voltage VG_H is between 6 and 8 volts, the voltage VG_L is between 1 and 3 volts, and the voltage VLS2 is between 0 and 2 volts. For example, the voltage VP is about 8 volts, the voltage VLS2 is about 2 volts, and the difference between the voltages VP and VLS2 (e.g. 6 volts) is smaller than or equal to the voltage across the working voltage range VRW1 of the matured process. According to the data signals DA, the digital-to-analog convertor DAC selects corresponded gamma voltage as driving signals DA_I to the buffer BUF, to make the buffer generate the driving signals DA_O to drive the display components of the OLED display device.

In the example shown in FIG. 1, the driving module 10 adjusts the maximum voltage of the data signals DA and the maximum working voltage of the driving unit 104 to be greater than or equal to the maximum driving voltage VG_H of the display components in the OLED display device, to make the driving signals DA_O able to drive the display components of the OLED display device. Further, the driving module 10 shifts the minimum voltage of the data signals DA and the minimum working voltage of the driving unit 104 to the voltage VLS2, to make the driving unit 104 operate in the working voltage range VRW1 of the circuit elements in the matured process and to avoid the circuit elements of the driving unit 104 being damaged. As a result, the driving module 10 used to drive the OLED display device is able to be realized in the matured process.

In addition, the example shown in FIG. 1 uses the driving unit 104 generating the display data of the display components in the OLED display device (e.g. a source driver) for illustrations. According to different applications and design concepts, the concept of the present disclosure may be applied to any circuits used to drive the OLED display device.

The above example shifts the working voltage range of the driving circuits upwardly, to allow the driving circuit realized in the matured process to drive the OLED display device without damaging the circuit elements. Accordingly, the user is able to implement the driving circuit of the OLED display device without using special process. The manufacture cost is significantly reduced, therefore.

Figure 2:
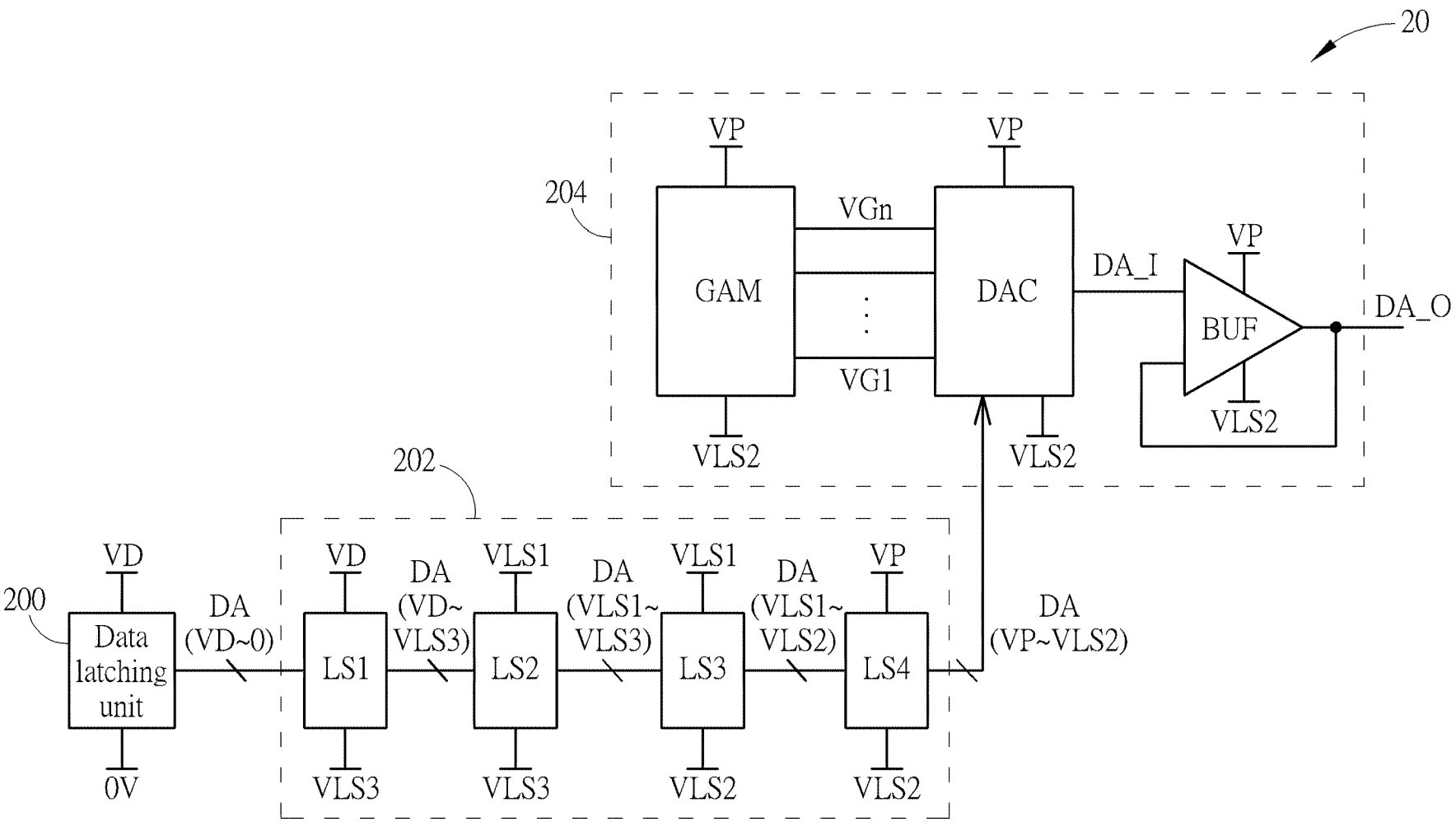
FIG. 2 is a schematic diagram of another driving module according to an example of the present invention.

According to different applications and design concepts, those with ordinary skill in the art may observe appropriate alternations and modifications. For example, the converting unit 102 used to adjust the voltage ranges can be realized by various methods. Please refer to FIG. 2, which is a schematic diagram of a driving module 20 according to an example of the present invention. The driving module 20 is similar to the driving module 10 shown in FIG. 1, thus the components and signals with similar functions use the same symbols. In FIG. 2, the converting unit 202 changes to use 4 stages of shifters LS1-LS4 to adjust the voltage ranges of the data signals DA. In an example, the shifters LS1-LS4 are level shifters. The shifter LS1 is utilized to decrease the minimum voltage of the data signals DA from the ground voltage to a voltage VLS3, wherein the voltage VLS3 is smaller than the ground voltage and the difference between the voltages VLS3 and VLS1 is smaller than the voltage across the working voltage range VRW1 (i.e. VD−VLS3≤VRW1 or VLS1−VLS3≤VRW1). The shifter LS2 is utilized to increase the maximum voltage of the data signals DA, which ranges from the voltage VD to VLS3, from the voltage VD to VLS1. The voltage VLS1 is between the voltages VD and VP. The shifter LS3 is utilized to increase the minimum voltage of the data signals DA, which ranges from the voltage VLS1 to VLS3, from the voltage VLS3 to VLS2, to generate the data signals ranging from the voltage VLS1 to VLS2. The shifter LS4 is utilized to increase the maximum voltage of the data signals DA, which ranges from the voltage VLS1 to VLS2, from the voltage VLS1 to VP, to generate the data signals DA ranging from voltage VP to VLS2.

Figure 3:
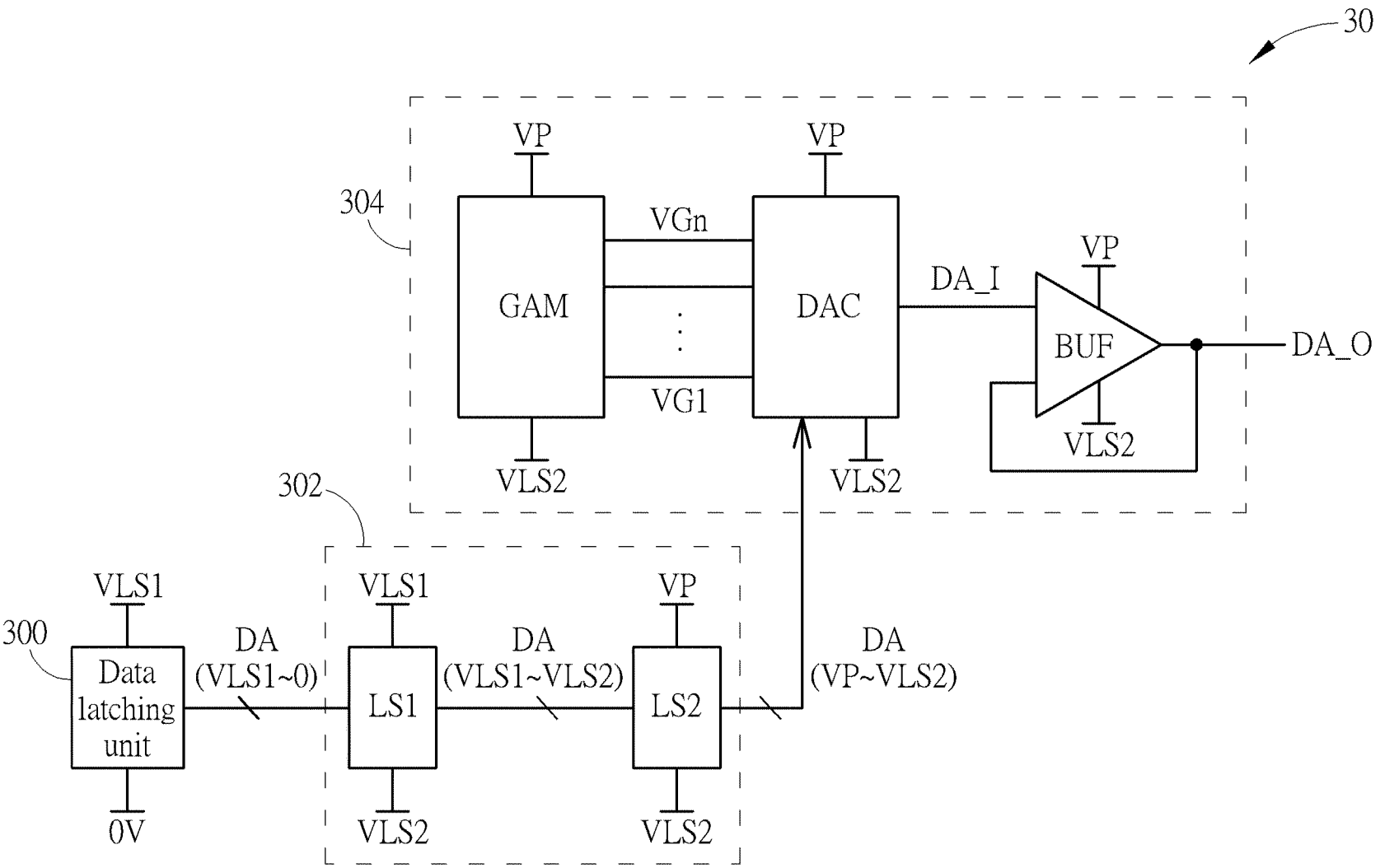
FIG. 3 is a schematic diagram of still another driving module according to an example of the present invention.

Please refer to FIG. 3, which is a schematic diagram of a driving module 30 according to an example of the present invention. The driving module 30 is similar to the driving module 10 shown in FIG. 1, thus the components and signals with similar functions use the same symbols. In FIG. 3, the working voltage range of the data latching unit 300 changes to be from the voltage VLS1 to the ground voltage. Under such a condition, the converting unit 302 can use 2 stages of shifters LS1 and LS2 to generate the data signals DA that ranges from the voltage VP to VLS2.

Figure 4:
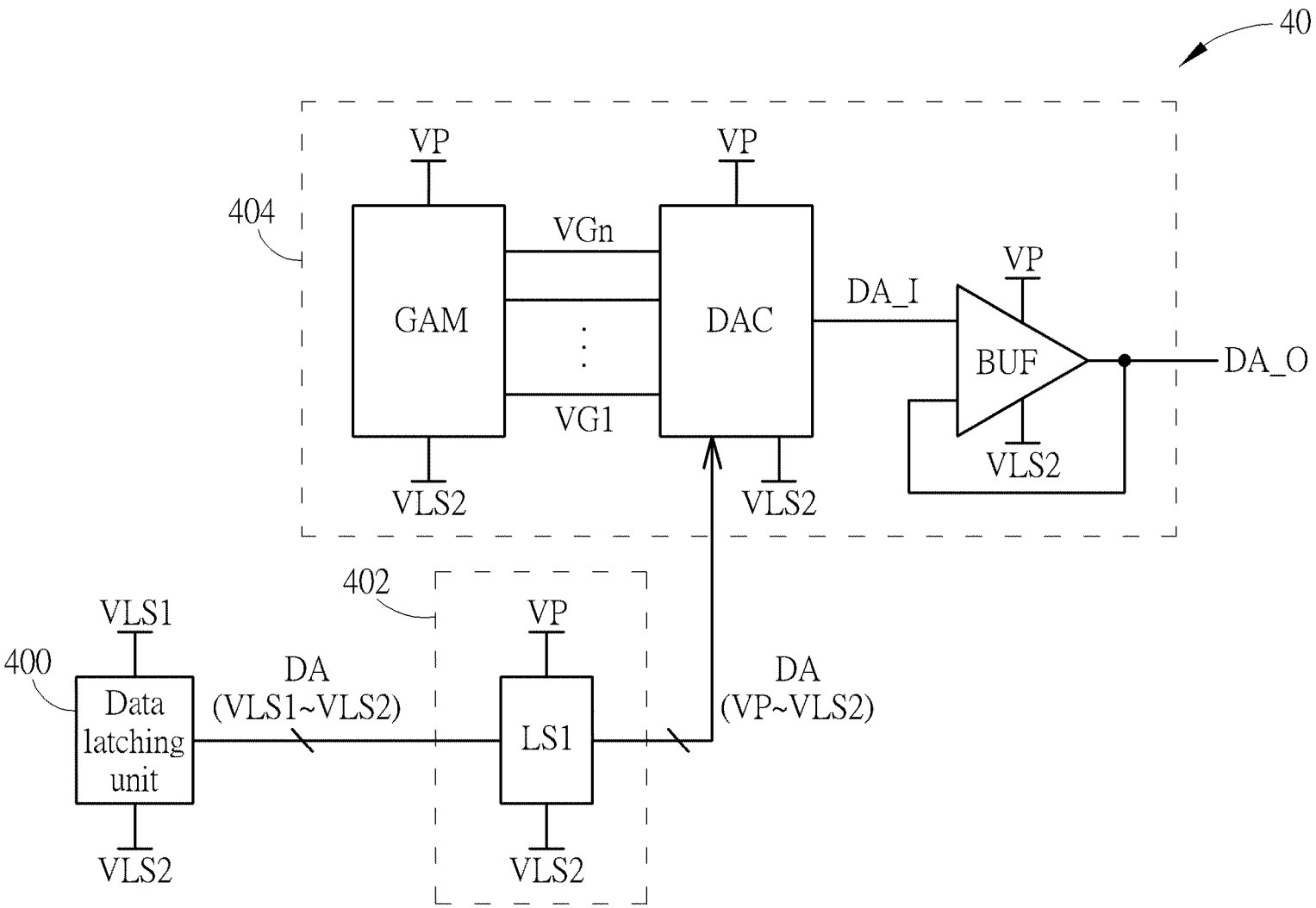
FIG. 4 is a schematic diagram of yet another driving module according to an example of the present invention.

Please refer to FIG. 4, which is a schematic diagram of a driving module 40 according to an example of the present invention. The driving module 40 is similar to the driving module 10 shown in FIG. 1, thus the components and signals with similar functions use the same symbols. Because the working voltage range of the data latching unit 400 changes to be from the voltage VLS1 to VLS2 in FIG. 4, the converting unit 402 can only use a shifter LS1 to generate the data signals DA that ranges from the voltage VP to VLS2.

In the examples shown in FIGS. 1-4, the converting unit of the driving module utilizes at least one stage of shifter to convert the voltage range of the data signals DA to at least one converting voltage range (e.g. the voltage ranges from the voltage VLS1 to the ground voltage and from the voltage VLS1 to VLS2 shown in FIG. 1), to generate the data signals DA that ranges from the voltage VP to VLS2. The voltage VP is greater than or equal to the maximum driving voltage VG_H of the display components in the OLED display device, the voltage VLS2 is smaller than or equal to the minimum driving voltage VG_L of the display components in the OLED display device, and the difference between the voltages VP and VLS2 is smaller than or equal to the voltage across the working voltage range VRW1 of the circuit components in the matured process. According to different applications and design concepts, the number of stages of shifters in the converting unit may be appropriately altered.

Figure 5:
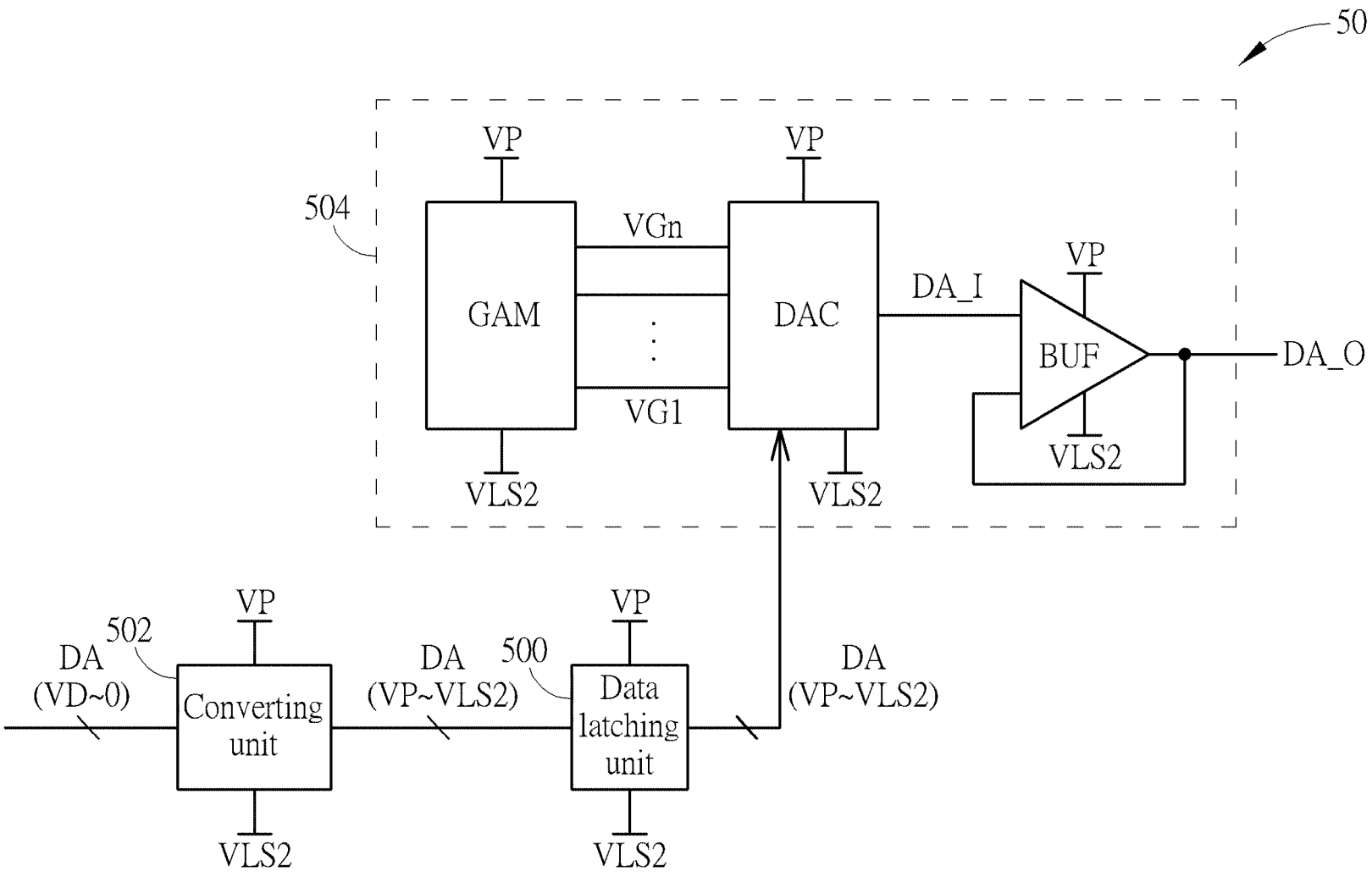
FIG. 5 is a schematic diagram of a driving module according to an example of the present invention.

Please refer to FIG. 5, which is a schematic diagram of a driving module 50 according to an example of the present invention. The driving module 50 is similar to the driving module 10 shown in FIG. 1, thus the components and signals with similar functions use the same symbols. In comparison with the driving module 10 shown in FIG. 1, the converting unit 502 changes to be pre-stage circuit of the data latching unit 500. In FIG. 5, the converting unit 502 adjusts the voltage range of the data signals DA from the voltage range of voltages VD-0 to the voltage range of VP-VLS2. The data latching unit 500 changes to work between the voltages VP-VLS2, to latch the data signals DA of the voltages VP-VLS2 and to output the data signals DA of the voltages VP-VLS2 according to a clock signal. In this example, the data latching unit 500 is directly coupled to the driving unit 504 because the voltage range of the data signals DA is adjusted to the voltage range of voltages VP-VLS2 before the data signals DA enters the data latching unit 500 and the data latching unit 500 also changes to working between the voltages VP-VLS2.

Via shifting the working voltage range of the driving circuit upwardly, the driving module of the above examples is able to drive the OLED display device without damaging the circuit elements. That is, the designer is able to implement the driving circuit of the OLED display device without using the special process. The manufacture cost is significantly reduced, therefore.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving module, comprising:

an organic light-emitting diode display device including display components, wherein the display components have a maximum driving voltage and a minimum driving voltage;

a converting circuit, for adjusting a voltage range of a plurality of data signals from a first voltage range to a second voltage range; and a driving circuit, for generating a plurality of driving signals within the second voltage range to the organic light-emitting diode display device according to the plurality of data signals, wherein the display components are coupled to the driving signals in the organic light-emitting diode display device;

wherein the maximum voltage of the second voltage range is greater than or equal to the maximum driving voltage, and the minimum voltage of the second voltage range is smaller than or equal to the minimum driving voltage;

wherein the maximum voltage of the second voltage range is greater than the maximum voltage of the first voltage range, and the minimum voltage of the second voltage range is greater than the minimum voltage of the first voltage range.

2. The driving module of claim 1, wherein the maximum voltage of the second voltage range is between 7-9 volts, the minimum voltage of the second voltage range is between 0-2 volts, the maximum driving voltage is between 6-8 volts, and the minimum driving voltage is between 1-3 volts.

3. The driving module of claim 1, wherein the maximum voltage of the second voltage range approximates to 8 volts and the voltage across the second voltage range approximates to 6 volts.

4. The driving module of claim 1, wherein the converting circuit comprises:

at least one level shifter, for converting the voltage ranges of the plurality data signals from the first voltage range to the second voltage range.

5. The driving module of claim 1, further comprising:

a data latching circuit, coupled to the converting circuit for latching and generating the plurality of data signals whose voltage range is the first voltage range.

6. The driving module of claim 1, further comprising:

a data latching circuit, coupled between the converting circuit and the driving circuit for latching the plurality of data signals whose voltage range is the second voltage range and outputting the plurality of data signals whose voltage range is the second voltage range to the driving circuit.

7. A driving module, comprising:

an organic light-emitting diode display device, comprising display components, wherein the display components have a maximum driving voltage and a minimum driving voltage;

a converting circuit, for adjusting a voltage range of a plurality of data signals from a first voltage range to a second voltage range; and a driving circuit, for generating a plurality of driving signals within the second voltage range to the organic light-emitting diode display device according to the plurality of data signals, wherein the display components are coupled to the driving signals in the organic light-emitting diode display device;

wherein the maximum voltage of the second voltage range is greater than or equal to the maximum driving voltage, and the minimum voltage of the second voltage range is smaller than or equal to the minimum driving voltage, so that the driving module is driven by a process wherein the maximum voltage of a working voltage range of said process is smaller than the maximum driving voltage, and wherein the minimum voltage of the working voltage range of said process is smaller than the minimum driving voltage;

wherein the maximum voltage of the second voltage range is greater than the maximum voltage of the first voltage range, and the minimum voltage of the second voltage range is greater than the minimum voltage of the first voltage range.

8. The driving module of claim 7, wherein the maximum voltage of the second voltage range is between 7-9 volts, the minimum voltage of the second voltage range is between 0-2 volts, the maximum driving voltage is between 6-8 volts, and the minimum driving voltage is between 1-3 volts.

9. The driving module of claim 7, wherein the maximum voltage of the second voltage range approximates to 8 volts and the voltage across the second voltage range approximates to 6 volts.

10. The driving module of claim 7, wherein the converting circuit comprises:

at least one level shifter, for converting the voltage ranges of the plurality data signals from the first voltage range to the second voltage range.

11. The driving module of claim 7, further comprising:

a data latching circuit, coupled to the converting circuit for latching and generating the plurality of data signals whose voltage range is the first voltage range.

12. The driving module of claim 7, further comprising:

a data latching circuit, coupled between the converting circuit and the driving circuit for latching the plurality of data signals whose voltage range is the second voltage range and outputting the plurality of data signals whose voltage range is the second voltage range to the driving circuit.

* * * * *